US010026548B2

(12) United States Patent
Suzuki et al.

(10) Patent No.: US 10,026,548 B2
(45) Date of Patent: Jul. 17, 2018

(54) REACTOR AND MANUFACTURING METHOD THEREOF

(71) Applicant: Tamura Corporation, Tokyo (JP)

(72) Inventors: Kotaro Suzuki, Sakado (JP); Kensuke Maeno, Sakado (JP); Ryo Nakatsu, Sakado (JP)

(73) Assignee: TAMURA CORPORATION (JP)

( * ) Notice: Subject to any disclaimer, the term of this patent is extended or adjusted under 35 U.S.C. 154(b) by 322 days.

(21) Appl. No.: 14/831,562

(22) Filed: Aug. 20, 2015

(65) Prior Publication Data

US 2015/0357117 A1 Dec. 10, 2015

Related U.S. Application Data

(62) Division of application No. 13/848,511, filed on Mar. 21, 2013, now Pat. No. 9,147,516.

(30) Foreign Application Priority Data

Mar. 23, 2012 (JP) ..... 2012-066589

(51) Int. Cl.
*H01F 41/02* (2006.01)
*H01F 27/02* (2006.01)
(Continued)

(52) U.S. Cl.
CPC ..... *H01F 41/0206* (2013.01); *H01F 27/02* (2013.01); *H01F 27/022* (2013.01);
(Continued)

(58) Field of Classification Search
CPC .. H01F 27/263; H01F 27/022; H01F 41/0206; Y10T 29/49073
See application file for complete search history.

(56) References Cited

U.S. PATENT DOCUMENTS 8,558,651 B2 10/2013 Suzuki
2009/0315663 A1 12/2009 Kiyono et al.
(Continued)

FOREIGN PATENT DOCUMENTS

JP 2007180140 7/2007
JP 2008-78219 4/2008
(Continued)

OTHER PUBLICATIONS

Notification of Reasons for Refusal for Japan Patent Application No. 2012-066589; dated Jan. 27, 2016 (w/ English machine translation); 9 pages.

*Primary Examiner* — Livius R Cazan

(57) ABSTRACT

First and second divisional cores each including right and left leg portions and a yoke interconnecting those together are formed by molding respective yoke-side core members in a resin. Cylindrical core mounting portions extending from the outer circumference of the surface of the yoke-side core member are formed integrally with the respective right and left leg portions of the first divisional core. I-shaped leg-portion-side core members and spacers are attached in the cylindrical core mounting portion formed in each of the right and left leg portions. The surface of the yoke-side core member molded in the resin and the surface of the leg-portion-side core member are disposed so as to have a spacer therebetween. The two divisional cores are joined together by butting respective leg portions of the two divisional cores with each other to form an annular mold core, and a coil is wound around the mold core.

2 Claims, 2 Drawing Sheets

(51) Int. Cl.

| | |
|---|---|
| ***H01F 27/26*** | (2006.01) |
| ***H01F 27/28*** | (2006.01) |
| ***H01F 41/00*** | (2006.01) |
| ***H01F 37/00*** | (2006.01) |

(52) U.S. Cl.
CPC ..... *H01F 27/263* (2013.01); *H01F 27/2823* (2013.01); *H01F 37/00* (2013.01); *H01F 41/005* (2013.01); *Y10T 29/49071* (2015.01); *Y10T 29/49073* (2015.01); *Y10T 29/49075* (2015.01)

(56) References Cited

U.S. PATENT DOCUMENTS

| | | | |
|---|---|---|---|
| 2010/0026434 | A1 | 2/2010 | Okamoto et al. |
| 2010/0102912 | A1 | 4/2010 | Suzuki et al. |
| 2011/0156853 | A1 | 6/2011 | Kato et al. |
| 2012/0139684 | A1 | 6/2012 | Kobayashi et al. |
| 2013/0038415 | A1 | 2/2013 | Ooishi et al. |

FOREIGN PATENT DOCUMENTS

| | | | |
|---|---|---|---|
| JP | 2009272508 | | 11/2009 |
| JP | 2010-238798 | | 10/2010 |
| JP | 2010-267932 | | 11/2010 |
| JP | 2010263075 | | 11/2010 |
| JP | 2011198847 | | 10/2011 |
| JP | 2012028572 | | 2/2012 |
| JP | 2012028572 | A * | 2/2012 |
| JP | 2013140827 | | 7/2013 |
| WO | 2011/132361 | | 10/2011 |

* cited by examiner

REACTOR AND MANUFACTURING METHOD THEREOF

CROSS-REFERENCE TO RELATED APPLICATIONS

This Divisional Application is based upon and claims the benefit of priority from U.S. patent application Ser. No. 13/848,511 filed on Mar. 21, 2013 which claimed priority from Japanese Patent Application No. 2012-066589, filed on Mar. 23, 2012; the entire contents of which are incorporated herein by reference.

FIELD OF THE INVENTION

The present invention relates to a reactor that is used for vehicles, such as an electric vehicle and a hybrid vehicle, and a manufacturing method of the reactor.

DESCRIPTION OF THE RELATED ART

Conventionally, a vehicular reactor is known which has a magnetic gap with a predetermined width between multiple cores in order to suppress a reduction of inductance. The reactor of this type uses an integrated core which has a spacer of ceramics or the like held in a gap between respective core members and which joins the adjoining core member and spacer by a bond.

A coil is wound around the core formed in this manner, thereby structuring a reactor. In this case, a mold core which has a resin-made bobbin or the whole core molded by a resin for insulation between the core and the coil is used. In particular, for vehicular reactors, a mold core is often used in consideration of the vibration resistance and the weather resistance as disclosed in JP 2008-78219 A, JP 2010-267932 A, and JP 2010-238798 A.

A core with a gap includes multiple core members and spacers. Hence, when a mold core of this type is manufactured, it is necessary to set the multiple core members and spacers in a die for resin molding, and to fill a resin in the die. However, it is difficult to precisely position the multiple core members and spacers in the die, and there is a disadvantage that the core members are mispositioned, or the shape of the die becomes complex in order to suppress such a mispositioning.

In order to suppress a mispositioning of the core members, each core member and spacer are connected by a bond in advance, set in the die, and then a resin is filled. According to this way, however, a bonding step of the core member with the spacer becomes necessary, and the manufacturing procedure becomes complicated.

As explained above, according to the conventional technology, a precise positioning of each core member and spacer in a mold core is difficult. Therefore, there is a case that the manufacturing of the mold core is difficult, or the manufactured mold core is sometimes unable to accomplish a performance as originally designed.

The present invention has been made in order to address the above-explained disadvantages of the conventional technology. That is, it is an object of the present invention to provide a reactor and a manufacturing method thereof which facilitate a positioning of a core member in a die, and which enable a precise placement of multiple core members and spacers in a molded resin.

SUMMARY OF THE INVENTION

A reactor according to an aspect of the present invention has following features:

(1) a first divisional core that includes right and left leg portions and a yoke interconnecting the leg portions together is formed by molding a first yoke-side core member in a resin;

(2) right and left surfaces of the first yoke-side core member molded in the resin are exposed at the right and left leg portions of the first divisional core, respectively;

(3) the right and left leg portions of the first divisional core each comprises a cylindrical core attaching portion which is formed integrally by the resin molded around the first yoke-side core member, and which extends from the outer circumference of the surface of the first yoke-side core member;

(4) an I-shaped leg-portion-side core member and a spacer are attached inside the cylindrical core attaching portion of each right and left leg portions, a surface of the first yoke-side core member molded in the resin and a surface of the leg-portion-side core member are disposed so as to have a spacer provided between both surfaces;

(5) a second divisional core comprising right and left leg portions and a yoke interconnecting the leg portions together is formed by molding a second yoke-side core member in a resin;

(6) right and left surfaces of the second yoke-side core member molded in the resin are exposed at right and left end portions of the second divisional core; and (7) an annular core is formed by causing an end of the first divisional core and an end of the second divisional core both structured as explained above to be joined together in a manner butted against each other, and a coil is wound around a leg portion of the annular core.

A manufacturing method of the reactor employing the above-explained structure is also an embodiment of the present invention.

According to the present invention, the following advantages can be accomplished:

(1) it is unnecessary to bond multiple core members prior to setting of the core members in a die. Furthermore, positioning of the core members in the die can be carried out easily and precisely since only a few core members must be set in the die;

(2) The resin-made mounting portions are formed by molding several core members in advance. This mounting portion regulates the position of each core member to be mounted to the divisional core later. As a result, mispositioning of the respective core members can be suppressed. This facilitates the manufacturing of the mold core including the multiple core members and spacers;

(3) positioning between adjoining core members and that between each core member and spacer can be ensured highly precisely, and thus the reactor can accomplish the performance as originally designed; and (4) the leg-portion-side core members and the spacers are mounted to only the first divisional core, and thus it is not necessary to mount of the leg-portion-side core members and the spacers to the second divisional core. Accordingly, mounting can be done at once.

DETAILED DESCRIPTION OF THE PREFERRED EMBODIMENT

1. Structure of Embodiment

Figure 1:
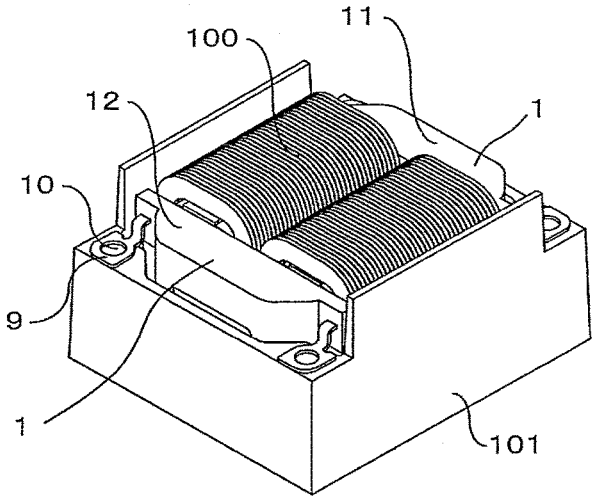
FIG. 1 is a perspective view illustrating a reactor according to an embodiment of the present invention in an assembled condition.
Figure 2:
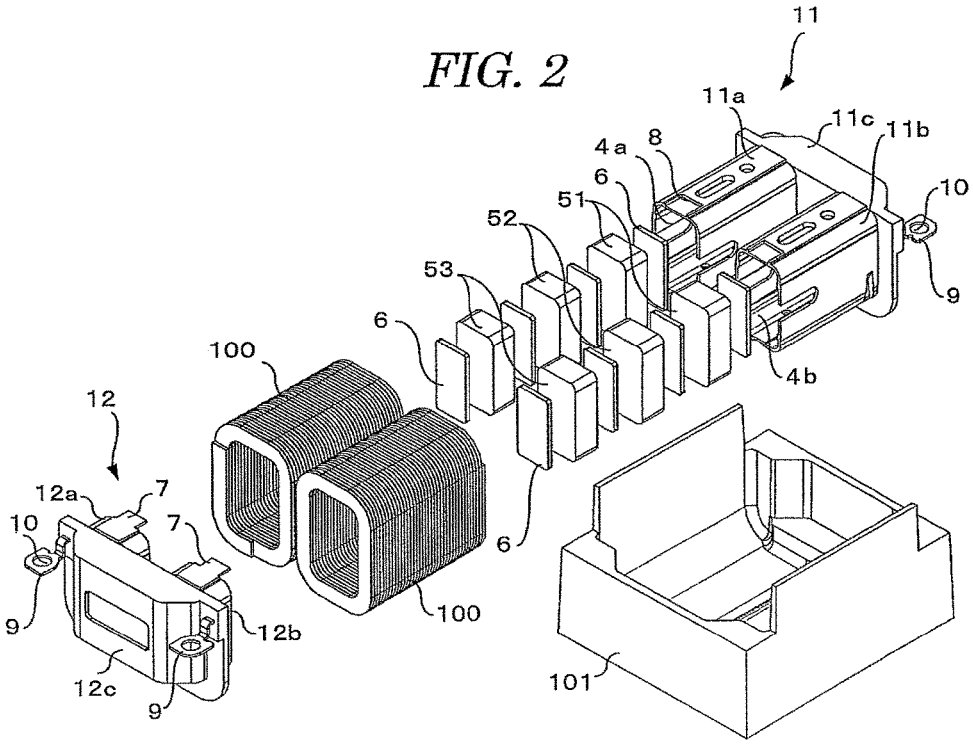
FIG. 2 is an exploded perspective view illustrating the reactor illustrated in FIG. 1.

As illustrated in FIGS. 1 and 2, a reactor according to an embodiment includes a mold core 1, a coil 100 wound around this mold core 1, and a casing 101 retaining there inside the mold core 1 and the coil 100. The mold core 1 has a first divisional core 11 and a second divisional core 12 integrated together in a manner abutting against each other and in an annular shape.

Figure 3:
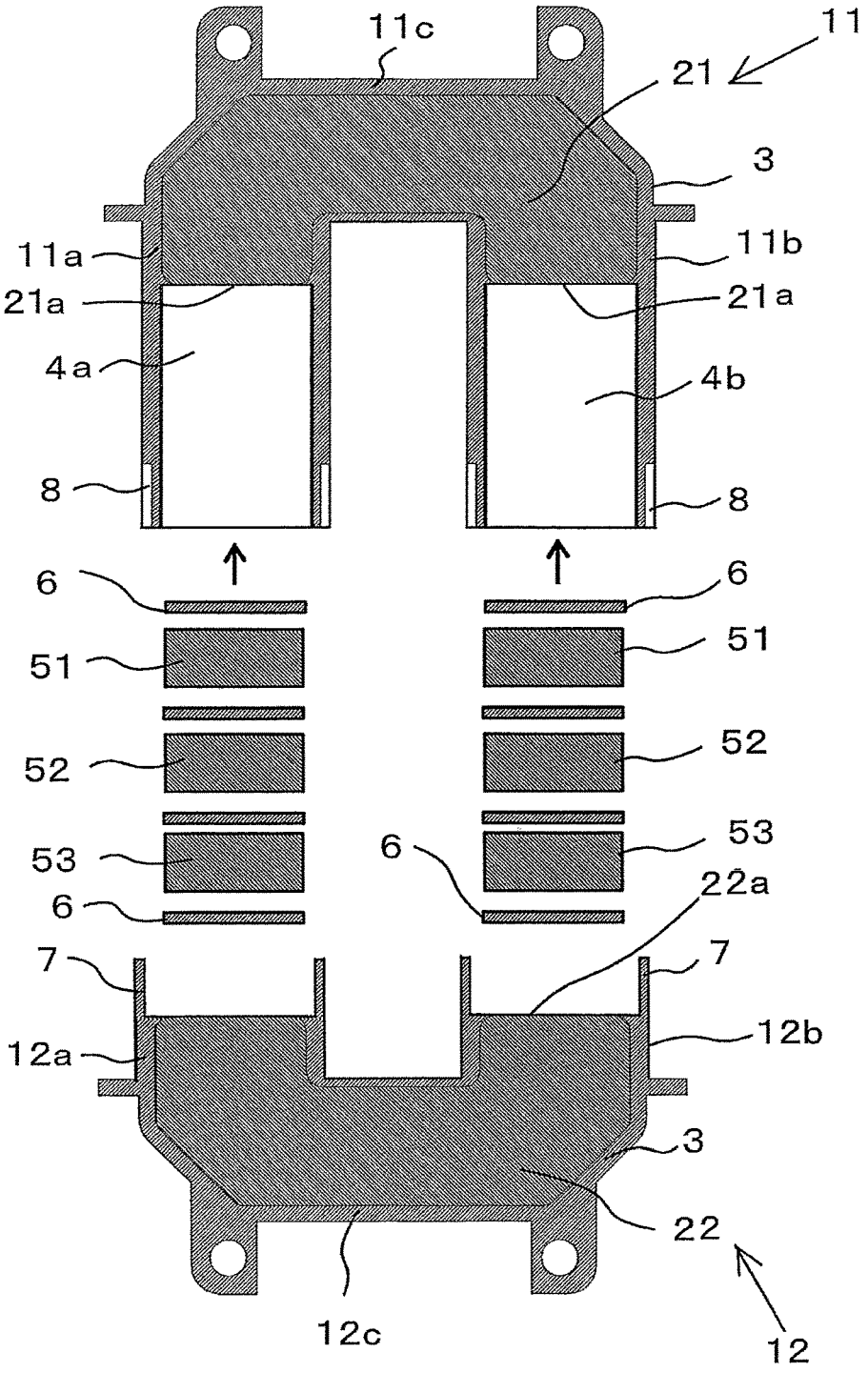
FIG. 3 is a cross-sectional view illustrating a manufacturing method of the reactor illustrated in FIG. 1.

The first divisional core 11 includes right and left leg portions 11*a* and 11*b*, and a yoke 11*c* interconnecting those leg portions. As illustrated in FIG. 3, the first divisional core 11 is formed by molding a U-shaped first yoke-side core member 21 in a resin 3. Respective surfaces 21*a* of the right and left ends of the yoke-side core member 21 molded in the resin 3 are exposed at the right and left leg portions 11*a* and 11*b* of the first divisional core 11.

The right and left leg portions 11*a* and 11*b* of the first divisional core 11 are provided with cylindrical core mounting portions 4*a* and 4*b* extending from the outer circumference of an end surface of the yoke-side core member 21. The core mounting portions 4*a* and 4*b* are formed together by the resin 3 molded on the outer circumference of the yoke-side core member 21. Leg-portion-side core members 51, 52, and 53 each in an I-shape are fitted in the cylindrical core mounting portions 4*a* and 4*b* with a spacer 6 held between the respective core members. The surface 21*a* of the end portion of the first yoke-side core member 21 molded in the resin 3 and the surface of the leg-portion-side core member 51 are disposed so as to have the spacer 6 therebetween.

The second divisional core 12 includes right and left leg portions 12*a* and 12*b*, and a yoke 12*c* interconnecting those leg portions together. As illustrated in FIG. 3, the U-shaped second divisional core 12 is formed by having a second yoke-side core member 22 molded in the resin 3. Surfaces 22*a* of the right and left ends of the second yoke-side core member 22 molded in the resin 3 are exposed at the respective ends of the right and left leg portions 12*a* and 12*b* of the second divisional core 12.

Latch members are provided at the respective tips of the leg portions 11*a* and 11*b* of the first divisional core 11. The latch members regulate the position between the first divisional core 11 and the second divisional core 12 when both are abut with each other. Specifically, recesses 8 are provided in the upper face and the lower face of each core mounting portion 4*a* and 4*b* of the first divisional core 11. Protruding tongue pieces 7 are provided on the upper face and the lower face of each leg portion 12*a* and 12*b* of the second divisional core 12. Protruding tongue pieces 7 are inserted into the respective recesses 8, thereby positioning the first divisional core 11 and the second divisional core 12.

Fasteners 9 are integrally provided at the yokes 11*c* and 12*c* of the first and second divisional cores 11 and 12. Those fasteners 9 fasten the mold core 1, around which the coil 100 is wound, to the casing 101. Each base portion of the fasteners 9 is molded in the resin 3, which configures the first and second divisional cores 11 and 12, together with the yoke-side core members 21 and 22, respectively. The fastener 9 is provided with a bolt hole 10. A separately prepared bolt is inserted in the bolt hole 10, and the tip of this bolt is screwed in an unillustrated threaded hole provided in the casing 101, thereby fastening the mold core 1 to the casing 101.

2. Action of Embodiment

The reactor of the embodiment employs the above-explained structure, and a method of manufacturing this reactor is as follow.

(1) The U-shaped first yoke-side core member 21 and the fastener 9 are set in a die for forming the right and left leg portions 11*a* and 11*b*, the yoke 11*c* interconnecting those together, and the cylindrical core mounting portions 4*a* and 4*b*. The resin 3 is filled in the die and cured. The first divisional core 11 thus manufactured is taken out from the die.

(2) The U-shaped second yoke-side core member 22 and the fasteners 9 are set in a die for forming the right and left leg portions 12*a* and 12*b*, and the yoke 12*c* interconnecting those together. The resin 3 is filled in the die and cured. The second divisional core 12 thus manufactured is taken out 30 from the die.

(3) The spacers 6 and the I-shaped leg-portion-side core members 51 to 53 are inserted into each core mounting portion 4*a* and 4*b* of the manufactured first divisional core 11. In this case, each core member and spacer may be joined by a bond, or simply the spacers 6 and the leg-portion-side core members 51 to 53 may be fitted into the core mounting portion 4*a* or 4*b*.

(4) The two core mounting portions 4*a* and 4*b* of the first divisional core 11 mounted with the core members and the spacers are respectively inserted through the coils 100, thereby mounting the coils 100 to the leg portions of the core.

(5) The respective ends of the core mounting portions 4*a* and 4*b* of the first divisional core 11 and the respective ends of the leg portions 12*a* and 12*b* of the second divisional core 12 are butted against each other in such a way that the spacers 6 fitted in the respective core mounting portions contact the respective surfaces 22*a* of the ends of the second yoke-side core member 22, thereby forming the annular mold core 1. In this case, the tongue pieces 7 of the second divisional core 12 are fitted into the recesses 8 of the first divisional core 1, thereby positioning the two divisional cores 11 and 12.

(6) The annular mold core 1 mounted with the coils 100 is retained in the casing 101, and the mold core 1 and the casing 101 are fastened together using unillustrated bolts and the fasteners 9.

3. Advantage of Embodiment

The reactor and the manufacturing method thereof according to the embodiment have following advantages.

(1) In this embodiment, only two core members, that are the yoke-side core members 21 and 22, are molded in the resin 3. Therefore, positioning of the core members in a die can be carried out easily and precisely in comparison with the conventional technology molding multiple core members simultaneously.

(2) The leg-portion-side core members 51 to 53 and the spacers 6 are guided by each cylindrical core mounting portion 4*a* and 4*b* formed of the resin 3 of the first divisional core 11, and positioned relative to the first yoke-side core member 8 molded in the resin 3. Accordingly, each core member and spacer can be precisely positioned.

(3) The leg-portions-side core members 51 to 53 and the spacers 6 are fitted into each cylindrical core mounting portion 4*a* and 4*b* formed of the resin 3 of the first divisional core 11. Therefore, it is not necessary to mount the leg-portion-side core members and the spacers into the second divisional core 12. Hence, the mounting of the leg-portion-side core members and the spacers and the joining of the two cores can be made simply in comparison with a case in which the leg-portion-side core members and the spacers are mounted into both divisional cores and then both divisional cores are joined together.

(4) The leg-portion-side core members and the spacers are held from the entire surroundings by each cylindrical core mounting portion 4*a* and 4*b* formed of the resin 3. Accordingly, each core member and spacer can ensure a contacting condition without a bond, and thus the assembling work is simplified. It is needless to say that a bond can be used.

(5) The leg-portion-side core members and the spacers are covered by each cylindrical core mounting portion 4*a* and 4*b* formed of the resin 3. Accordingly, the coil 100 and the core members are surely insulated from each other.

(6) The two divisional cores 11 and 12 are fixed by fastening the fasteners 9 at both ends to the casing 101 by means of bolts. Accordingly, another member for maintaining the joined condition of both divisional cores is unnecessary at the joined portion of the divisional cores. In particular, it is unnecessary to provide an engagement member at the joined portion, fix the joined portion by adding a resin therearound, or use a coil bobbin so as to prevent a separation of the two cores. This simplifies the structure of the reactor.

4. Other Embodiments

The present invention is not limited to the above-explained embodiment, and covers the following other embodiments.

(1) The number of leg-portion-side core members and that of spacers mounted inside of each cylindrical core mounting portion 4*a* and 4*b* are not limited to the illustrated numbers, and may be larger or smaller numbers. Moreover, individual leg-portion-side core member and spacer may have different dimension in the axial direction of the leg portion (i.e., thickness) between the right and left core mounting portions 4*a* and 4*b*. The core members and the spacers having a different dimension may be used even in the same core mounting portion 4*a* and 4*b*.

(2) The first yoke-side core member 21 and the second yoke-side core member 22 may be in an I-shape instead of the U-shape. In this case, exposed portions facing with the leg portion of the annular core are provided at the right and left side surfaces of each I-shaped yoke-side core members 21 and 22. The I-shaped cores for the leg portions are disposed so as to face the exposed portions with the spacers 6 therebetween.

(3) The work of attaching the leg-portion-side core members and the spacers to the first divisional core 11 and the work of attaching the coil can be carried out in any sequence.

(4) Other means for fastening the two butted divisional cores 11 and 12 together may be employed in addition to the fastening the fasteners provided at the mold cores to the casing by bolts. For example, the two divisional cores 11 and 12 may be fastened by a belt-shaped fastener wrapped around the divisional cores, or the whole annular mold core and coil may be further molded by the resin.

(5) The latch members for positioning the two divisional cores may be provided at portions other than the mounting portions of the divisional cores 11 and 12. Moreover, other than the above-explained tongue pieces 7 and recesses 8 simply positioning the divisional cores, engagement members, such as a recess and a hook engaged with the recess can be employed to suppress a separation of the combined two divisional cores. The core mounting portions of the one divided core may be provided with a tongue piece and a recess, and another core mounting portions may be provided with a recess and a tongue piece respectively corresponding to the former tongue piece and recess. Furthermore, a cylindrical member may be provided which enables the tip of the one core mounting portion to be fitted in the tip of another core mounting portion. The portion where the latch member is provided is not limited to the core mounting portion, and the latch member can be provided at another portion of the leg portion.

What is claimed is:

1. A method of manufacturing a reactor, the method comprising steps of:

manufacturing a first divisional core by setting a first yoke-side core member in a die, filling a resin in the die and curing the resin to mold the first yoke-side core member in the resin with ends of the first yoke-side core member exposed, and forming a pair of cylindrical core mounting portions at the ends of the first yoke-side core member in the mold resin;

manufacturing a second divisional core by setting a second yoke-side core member in a die, filling a resin in the die and curing the resin to mold the second yoke-side core member in the resin with ends of the second yoke-side core member exposed;

mounting an I-shaped leg-portion-side core member in each of the pair of cylindrical core mounting portions formed in the first divisional core;

inserting the two core mounting portions provided in the first divisional core to which the core member are mounted through coils; and abutting each end of leg portions of the first divisional core to which the coils are mounted against each end of leg portions of the second divisional core to form an annular mold core.

2. The reactor manufacturing method according to claim 1, further comprising a step of fastening the annular mold core around which the coil is wound to a casing.

* * * * *